US005347703A

United States Patent [19]

Imashimizu et al.

[11] Patent Number: 5,347,703

[45] Date of Patent: Sep. 20, 1994

[54] METHOD OF COUPLING A MODULE FRAMEWORK TO A SHIP STRUCTURE

[75] Inventors: Yoshinori Imashimizu; Yoshiaki Suda; Shuichi Yamamoto, all of Kure; Toshiyuki Takada, Hiroshima; Kaoru Maeyama, Kure; Etsuro Hiramoto, Hiroshima; Toshihide Oki, Kure; Sadayuki Morita, Hyogo; Shoji Kawatani, Kure; Kunihito Morioka, Kure; Ryoichi Fujimitsu, Kure; Kazuhisa Handa, Kure, all of Japan

[73] Assignee: Ishikawajima-Harima Jukogyo Kabushiki Kaisha, Tokyo, Japan

[21] Appl. No.: 26,012

[22] Filed: Mar. 4, 1993

Related U.S. Application Data

[62] Division of Ser. No. 745,246, Aug. 14, 1991, Pat. No. 5,226,583.

[30] Foreign Application Priority Data

| | | | |
|---|---|---|---|
| Aug. 21, 1990 | [JP] | Japan | 2-218160 |
| Oct. 26, 1990 | [JP] | Japan | 2-112285 |
| Oct. 26, 1990 | [JP] | Japan | 2-289678 |
| Oct. 30, 1990 | [JP] | Japan | 2-292444 |
| Oct. 31, 1990 | [JP] | Japan | 2-294127 |

[51] Int. Cl.[5] ..... B23P 11/00

[52] U.S. Cl. ..... 29/525.1; 29/462; 29/897.31; 403/286

[58] Field of Search ..... 403/230, 231, 286, 393, 403/396; 29/525.1, 462, 469, 897.312, 897.32, 428, 464, 897.31

[56] References Cited

U.S. PATENT DOCUMENTS

| | | | |
|---|---|---|---|
| 384,196 | 6/1888 | Duvai | 29/428 |
| 1,804,420 | 5/1931 | Kelley | 29/525.1 |
| 2,176,926 | 10/1939 | Samuelson | 29/462 |
| 2,240,310 | 4/1941 | McKay | 29/525.1 |
| 3,828,515 | 8/1974 | Galgoczy et al. | 29/525.1 X |
| 3,849,012 | 11/1974 | Krouse | 29/464 X |
| 3,890,697 | 6/1975 | Horioka | 29/525.1 X |
| 3,977,147 | 8/1976 | Fletcher et al. . | |
| 4,014,089 | 3/1977 | Sato et al. | 29/525.1 |
| 4,561,372 | 12/1985 | Franz et al. . | |
| 5,226,583 | 7/1993 | Imashimizu et al. | 228/182 |

*Primary Examiner*—Timothy V. Eley
*Assistant Examiner*—Khan V. Nguyen
*Attorney, Agent, or Firm*—Oblon, Spivak, McClelland, Maier & Neustadt

[57] ABSTRACT

A module frame work to which outfits are mounted is manufactured with high accuracy and is installed to a larger structure without adjustment operation. The module frame work comprises a pair of horizontal and mutually parallel main beams, a pair of beam members connecting the main beams, support columns vertically extending from each of junctions of the main beams with the beam members and at least a connector on an end of any of the main beams, beam members and support columns.

1 Claim, 25 Drawing Sheets

METHOD OF COUPLING A MODULE FRAMEWORK TO A SHIP STRUCTURE

This is a division of application Ser. No. 07/745,246, filed on Aug. 14, 1991 is issued for U.S. Pat. No. 5,226,583.

BACKGROUND OF THE INVENTION

The present invention relates to a module frame work in modulation of a larger structure such as an engine room of a larger ship to which outfittings are mounted together, a method and device for assembling a module frame work and a coupler for a module frame work.

An engine room of a ship has a wide variety of outfittings such as machinery, piping and wiring installed and fixed to a hull. Normally, a deck of the hull is built and then outfittings are brought on or below the deck or into the hull for their installation and fixing on or below the deck.

This conventional system has many inboard operations in installation and fixing which are carried out with poor environmental conditions so that its working efficiency is low and a period up to completion tends to be prolonged. The inboard installation and fixing operations will require frequent adjustments during the operations due to size or dimensional errors, which further lowers the working efficiency.

In order to overcome such problems, contemplated is a method of dividing outfittings into a plurality of blocks and mounting the outfitting blocks to a module frame work or works in advance in a factory. The outfitting blocks are then brought into a ship together with a module frame work or works for installation. A further module frame work or works with other outfittings are brought in for connection of the further frame work or works with the previously brought-in module frame work or works as well as for interconnection of the outfittings.

This contemplated method would drastically reduce operations inboard and shorten a period of installation and fixing since, merely, the module frame works manufactured outboard and with outfittings mounted thereto were brought inboard for connection.

However, the contemplated method has been regarded impractical. Because, module frame works are huge in size and are assembled rigid by welding or the like for support of heavy loads or objects so that it is very difficult to maintain size or dimensional accuracy of the module frame works against size or dimensional error of material or welding distortion. If the dimensional accuracy is not maintained, an extra operation is required for adjustment between module frame works and/or between outfittings upon installation in the ship. Such adjustment requires much time and labor and hinders improvement of working efficiency.

A primary object of the present invention is, therefore, to provide a module frame work in modulation of a larger structure, a method and device for assembling a module frame work and a coupler for a module frame work by which a module frame work for a larger and heavier object can be manufactured by welding with high accuracy and can be installed without adjustment operation.

The invention as claimed in claim 1 refers to a module frame work for a larger structure with a flat shape to which outfittings are installed, comprising a pair of horizontal and mutually parallel main beams, a pair of beam members connecting said main beams and a connector on at least one end of said main beams and/or said beam members.

The invention as claimed in claim 2 refers to a module frame work for a larger structure having three-dimensional shape to which outfittings are installed, comprising a pair of horizontal and mutually parallel main beams, a pair of beam members connecting said main beams, a support column extending vertically from each joint of said main beams with said beam members and a connector on at least one end of said main beams, said beam members and/or said support columns.

The invention as claimed in claim 3 refers to a module frame work for a larger structure having three-dimensional form to which outfittings are installed, comprising a horizontal and substantially rectangular floor member, a support column extending vertically from each corner of said floor member and a connector on at least one end of said support columns.

The invention as claimed in claim 4 refers to a method for combining a module frame work, which comprises assembling by welding main beams, beam members and support columns, or a floor member and support columns by welding, removing weld distortion of welded portions, positioning and maintaining the combined parts, accurately positioning and maintaining at least a connector in position relative to any of the main beams, beam members and support columns and welding said connector to the corresponding main beam, beam member or support column.

The invention as claimed in claim 5 refers to a device for assembling a module frame work, comprising means for positioning main beams and beam member welded together, or main beams, beam members and support columns welded together, or a floor member and support columns welded together, and a connector support bracket for positioning and maintaining a connector in position relative to any of the main beams, beam members and support columns.

The invention as claimed in claim 6 refers to a coupler for a module frame work for a larger structure, comprising elbow plates respectively fixed to an inside portion of the larger structure and to a module frame work arranged inside of the larger structure and doubling plates connected by bolts to said elbow plates to connect said larger structure with the module frame work, some of bolt holes for said bolts being horizontally extending slots.

The invention as claimed in claim 7 refers to a coupler for a module frame work for a larger structure, comprising a guide rail along which the module frame work is installed, said guide rail serving as part of reinforcement means for the larger structure.

The invention as claimed in claim 8 refers to a coupler according to claim 7 wherein a great number of guide rails are arranged in longitudinal direction.

In the following, description will be given on preferred embodiments of the present invention in connection with the drawings.

DETAILED DESCRIPTION OF PREFERRED EMBODIMENTS

Figure 1:
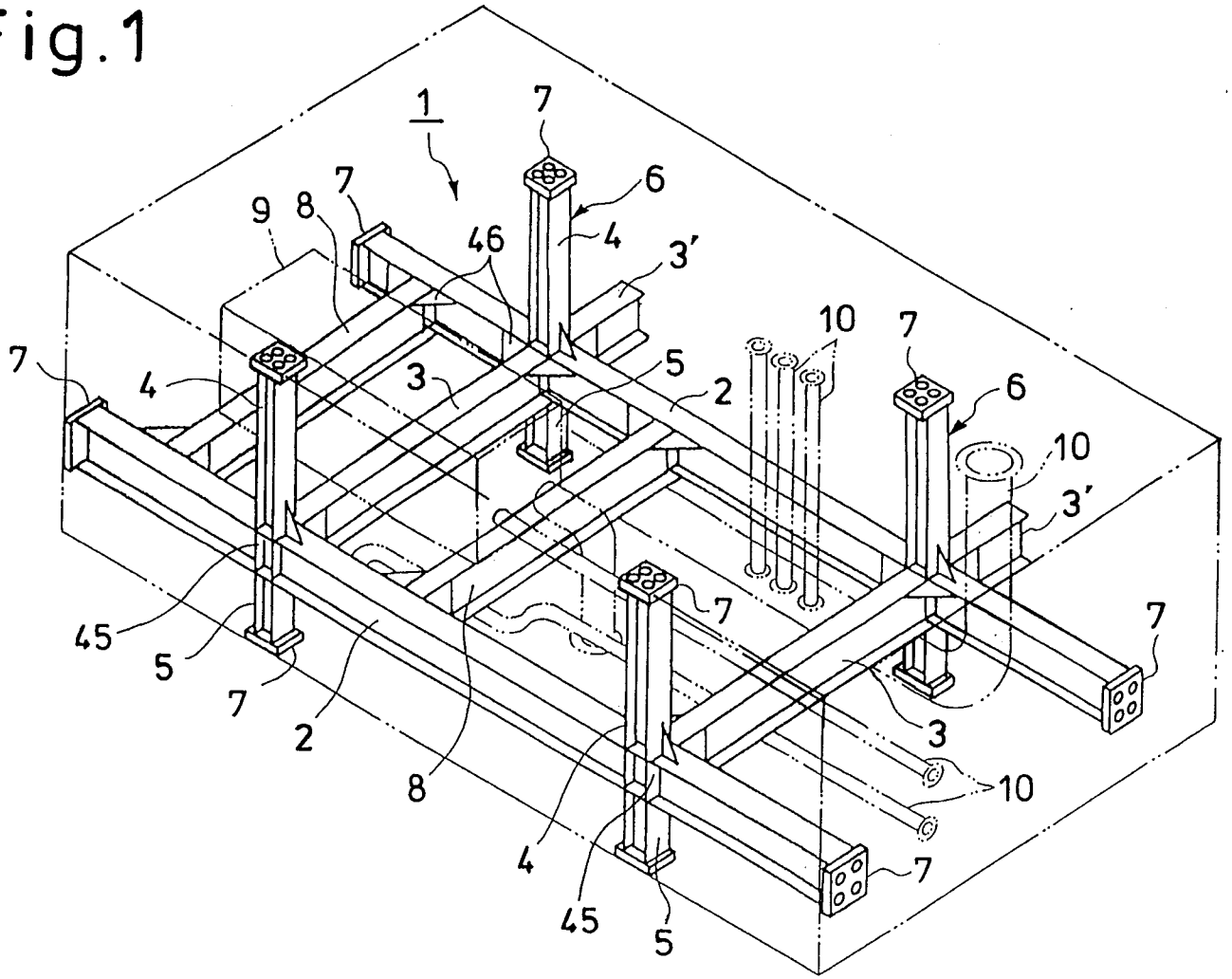
FIG. 1 is a perspective view of a first embodiment of a module frame work according to the present invention.
Figure 2:
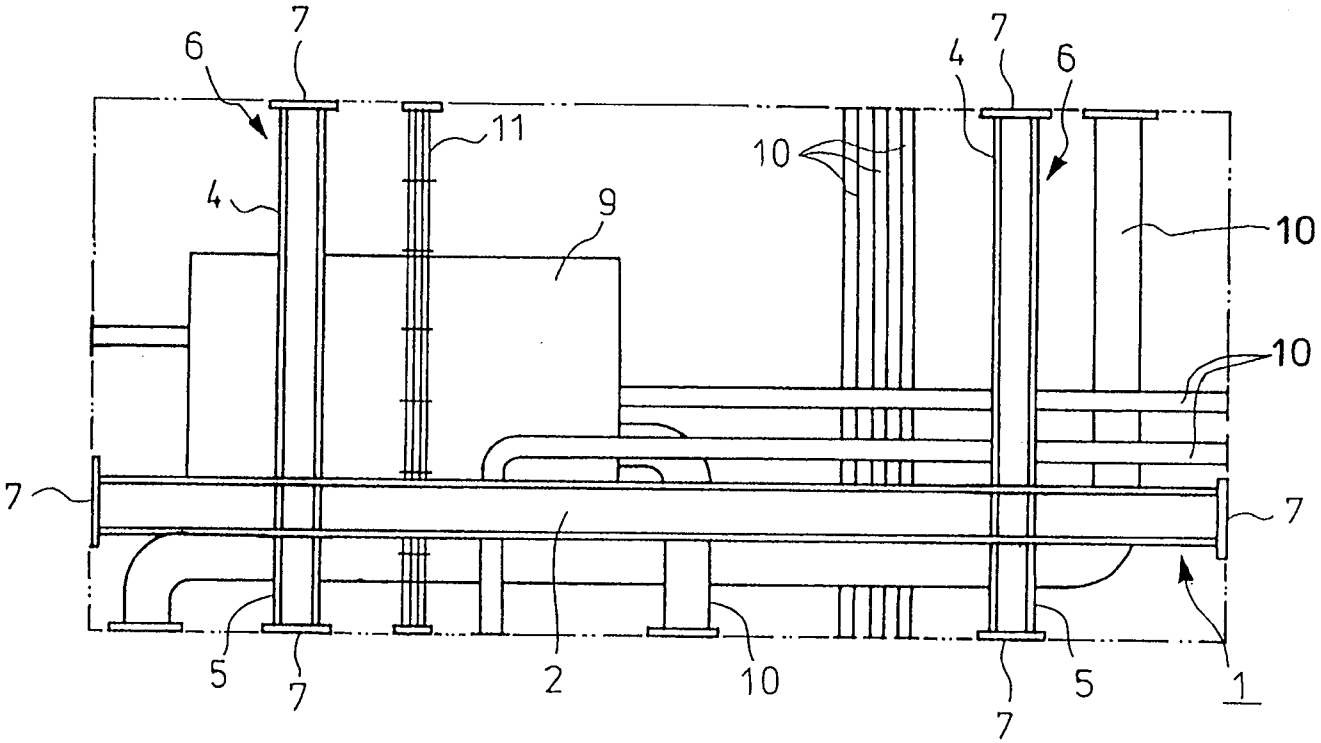
FIG. 2 is a side view thereof.

FIGS. 1 and 2 show a typical basic form of module frame work 1 according to the present invention which comprises a pair of horizontal and mutually parallel main beams 2, a pair of horizontal and mutually parallel beam members 3 extending perpendicular to and between the main beams 2 and rigidly welded at their opposite ends to the main beams 2 and four support columns 6 each having upper and lower column portions 4 and 5 rigidly welded to and extending vertically from each junction of the main beams 2 with the beam members 3.

A flanged connector 7 is rigidly welded to a predetermined position (connector-mounting position) or on each end of the module frame work 1.

In the figures, reference numeral 8 represents an auxiliary beam added for support of outfits or outfittings such as heavy machinery 9; 3', an extension for connecting and restraining the module frame work 1 to a stationary member of a hull structure such as bulkhead when the module frame work 1 is installed in the ship: 45, a reinforcement rib; and 46, a reinforcement bracket.

The module frame work 1 is assembled to have size in width, length and height concurring with high accuracy with a hexahedral container size shown by imaginary lines.

In addition to the machinery 9, the module frame work 1 has various outfits or outfittings such as piping 10 and wiring 11 mounted thereto.

Next, description is given on a device 12 for assembling the module frame work 1 in conjunction with FIGS. 3 to 9.

Figure 3:
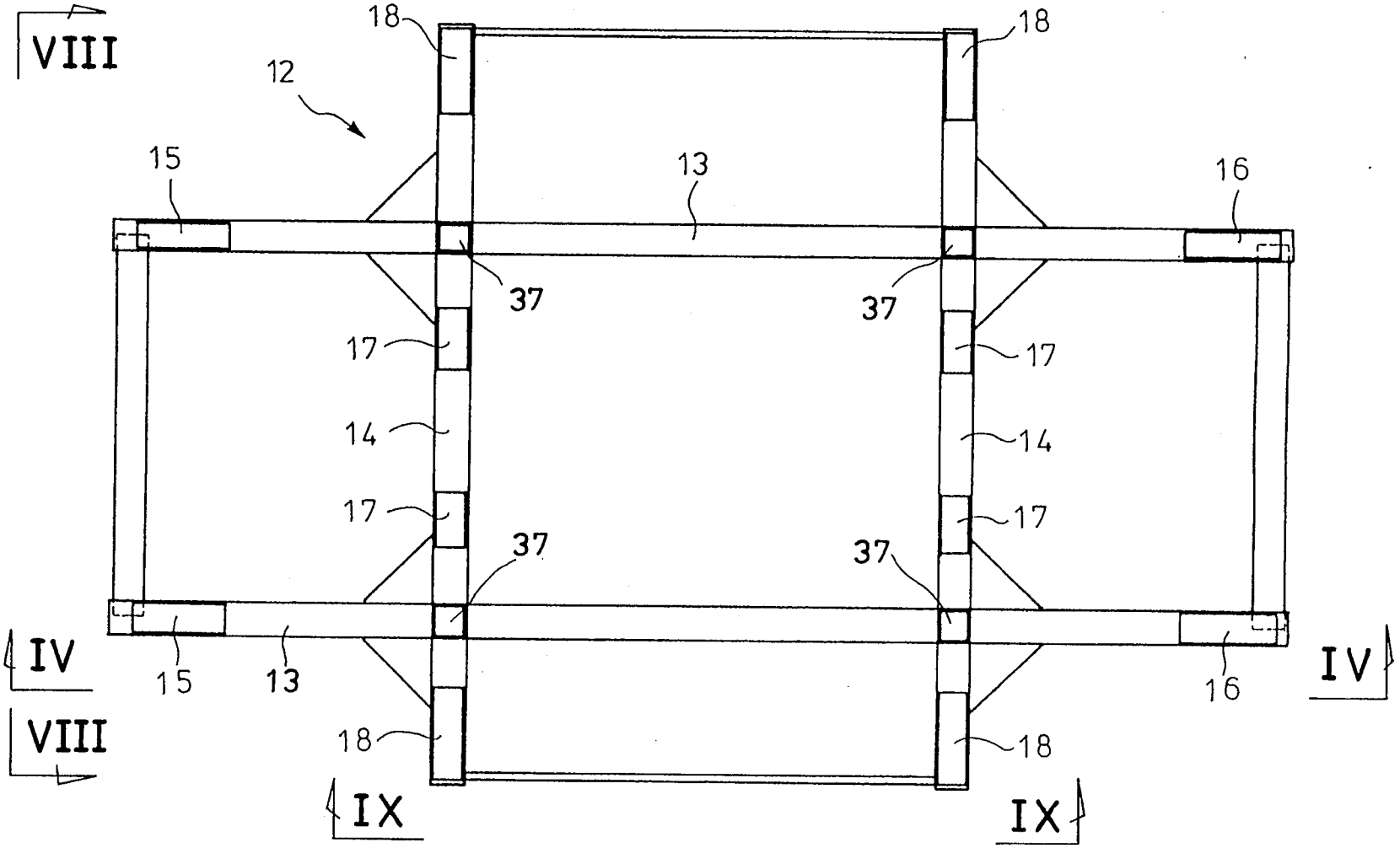
FIG. 3 is a plan view of a device for assembling a module frame work shown in FIG. 1.

As shown in FIG. 3, a pair of mutually parallel, longitudinal frames 13 having the same spacing as that of the main beams 2 of the module frame work 1 and longer than the beams 2 are combined on a ground in the form of "#" with a pair of lateral frames 14 extending perpendicular to the longitudinal frames 13 and having the same spacing as that of the beam members 3 of the module frame work 1. Fixed-side positioning means 15 are mounted on one-side ends of the longitudinal frames 13 to position the main beams 2 in longitudinal, lateral and vertical directions and moving-side positioning means 16, on the other ends of the frames 13.

Beam supports 17 are mounted on upper surfaces of the lateral frames 14 between the longitudinal frames 13 and have the same height as that of the lower column portions 5 of the module frame work 1. Upper positioning bases 18 having substantially the same height as that of the upper column portions 4 of the module frame work 1 are fixed at four points or on each end of the lateral frames 14.

Figure 4:
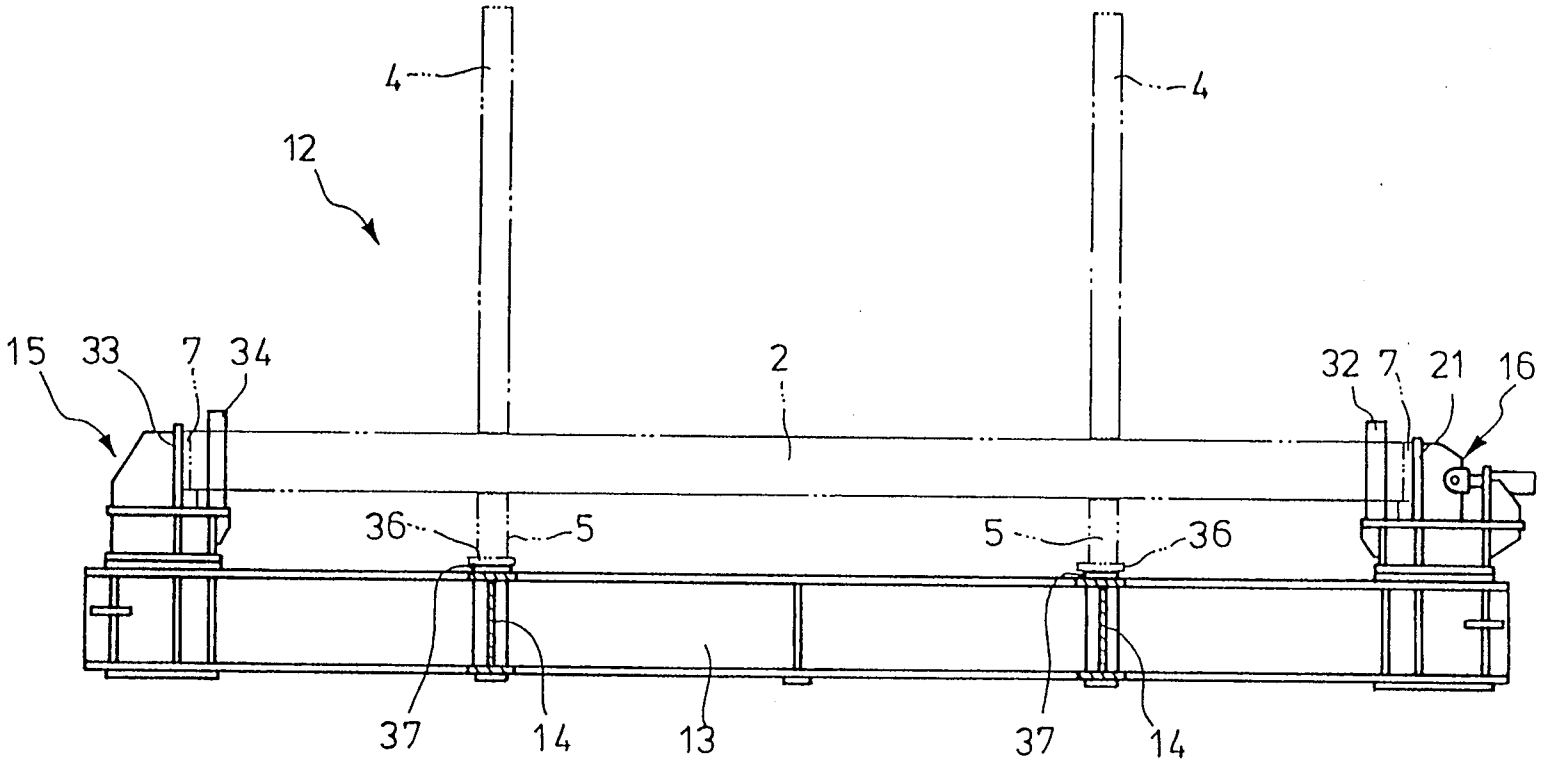
FIG. 4 is a sectional view taken along the line IV—IV in FIG. 3.
Figure 5:
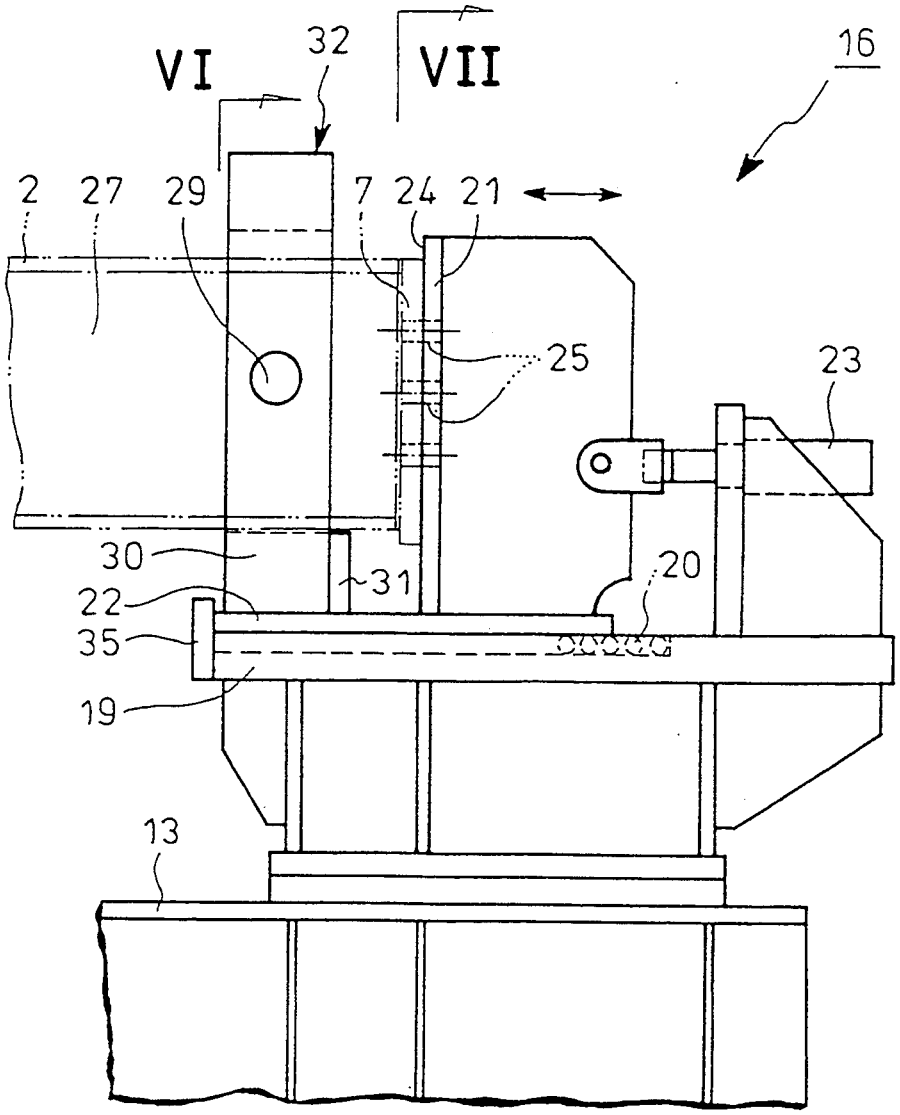
FIG. 5 is a partial enlarged view of FIG. 4.
Figure 6:
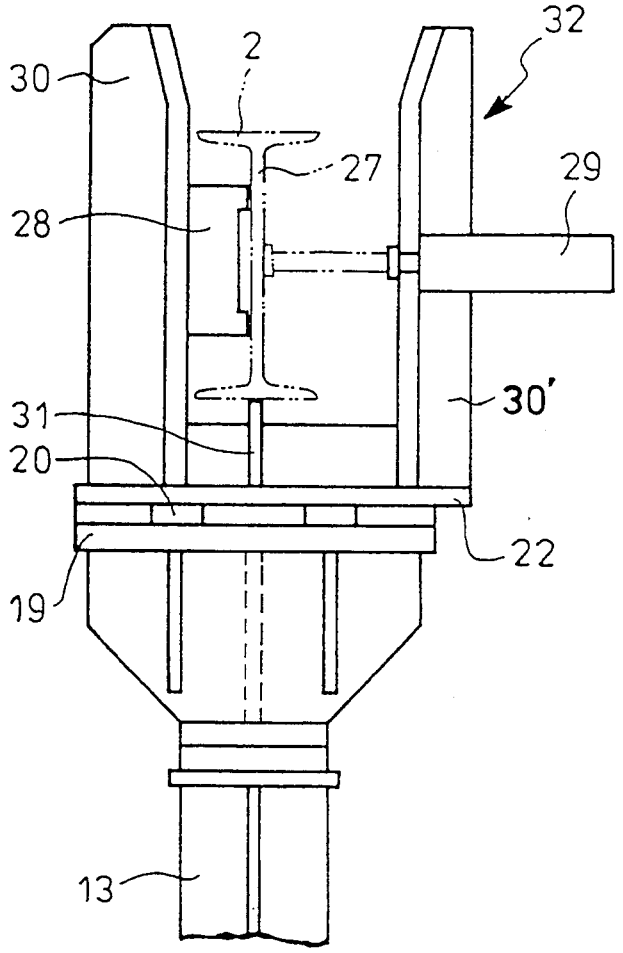
FIG. 6 is a view looking in the direction of arrow VI in FIG. 5.

As shown in FIGS. 4, 5 and 6 in detail, the moving-side positioning means 16 comprises a movable base 22 which is movable by liner rollers 20 or the like along the length of the longitudinal frames 13 and which has thereon a connector support bracket 21 for lateral positioning. The base 22 and the support bracket 21 are moved by a cylinder 23.

Figure 7:
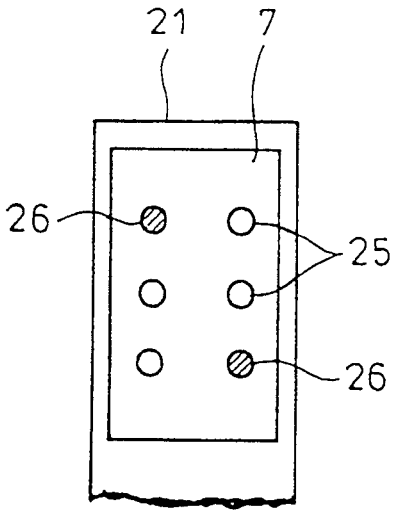
FIG. 7 is a view looking in the direction of arrow VII in FIG. 5.

The support bracket 21 has an inner surface 24 (see FIG. 5) to which the flanged connector 7 is fixed with high positioning accuracy and for example, as shown in FIG. 7, reamer pins 26 are inserted into two opposed ones among through holes 25 and bolts and nuts (not shown) are used for connection through the other holes 25.

The movable base 22 has a main-beam positioning base 32 at a position inside of the support bracket 21. As shown in FIG. 6, the positioning base 32 has a guide member 30 with a positioning block 28 for supporting at its two vertically spaced points one side surface of a vertical web 27 of the I-shaped main beam 2 for longitudinal and lateral positioning of the main beam 2, a guide member 30' with a pushing cylinder 29 for pushing the other side surface of the web 27 toward the positioning block 28 and a height positioning plate 31 for supporting the vertical web 27 in height so that a lower surface of the main beam 2 is coplanar with the tops of the lower column portions 5.

The moving-side positioning means 16 has a stationary base 19 with its inner end having a positioning stop 35 on which the movable base 22 may abut so that spacing between the support bracket 21 and a support bracket 33 (see FIG. 4) can be maintained constant with high accuracy.

The fixed-side positioning means 15 has, as shown in FIG. 4, a connector 33 and a main-beam positioning base 34 which are of the same arrangement and of the same height as those of the support bracket 21 and the positioning base 32 of the moving-side positioning means 16.

Each of the junctions of the longitudinal frames 13 with the lateral frames 14 has at its upper surface a support bracket 37 which is of the same structure as that of the support bracket 21 as shown in FIG. 7 to effect positioning through tightening of a flanged connector 36 rigidly attached to a lower end of the lower column portion 5.

The upper positioning base 18 has at its top a guide member 39 having a frustoconical guide hole 38. An upper guide bar 41 with frustoconical guide projections 40 at its opposite bottom ends laterally strides over the bases 18 and engage with the latter by fitting the projections 40 into the holes 38 to thereby maintain the height of the guide bar 41 constant. Upper positioning means 42 is thus provided.

The upper guide bar 41 has at its bottom surface support brackets 43 which are vertically aligned with the support brackets 37 and are of the same structure as that of the latter so as to fix in position the connectors 7 on the tops of the upper column portions 4. The upper guide bar 41 has at its upper surface suspension hooks 44.

In the following, description will be given on a procedure for assembling the module frame work 1 on the basis of FIGS. 10 to 16 and with reference to FIGS. 3 to 9.

Figure 10:
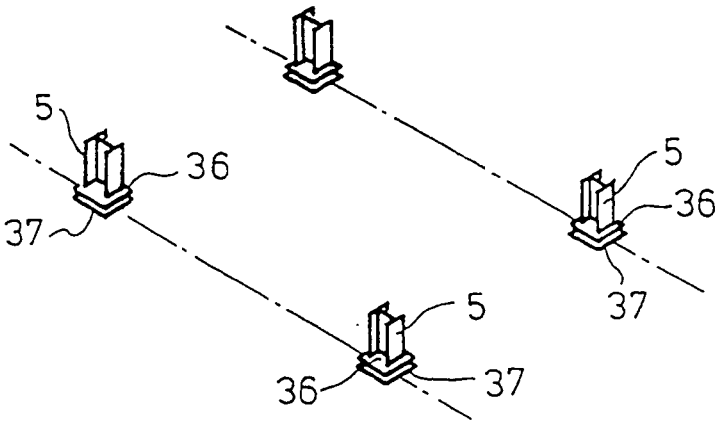
FIG. 10 is a view showing a first step of assembling a module frame work by use of the assembling device of FIG. 3.

First, as shown in FIG. 10, the lower column supports 5 are positioned and fixed through the flanges 36 to the support brackets 37 on the junctions of the longitudinal frames 13 with the lateral frames 14.

Figure 11:
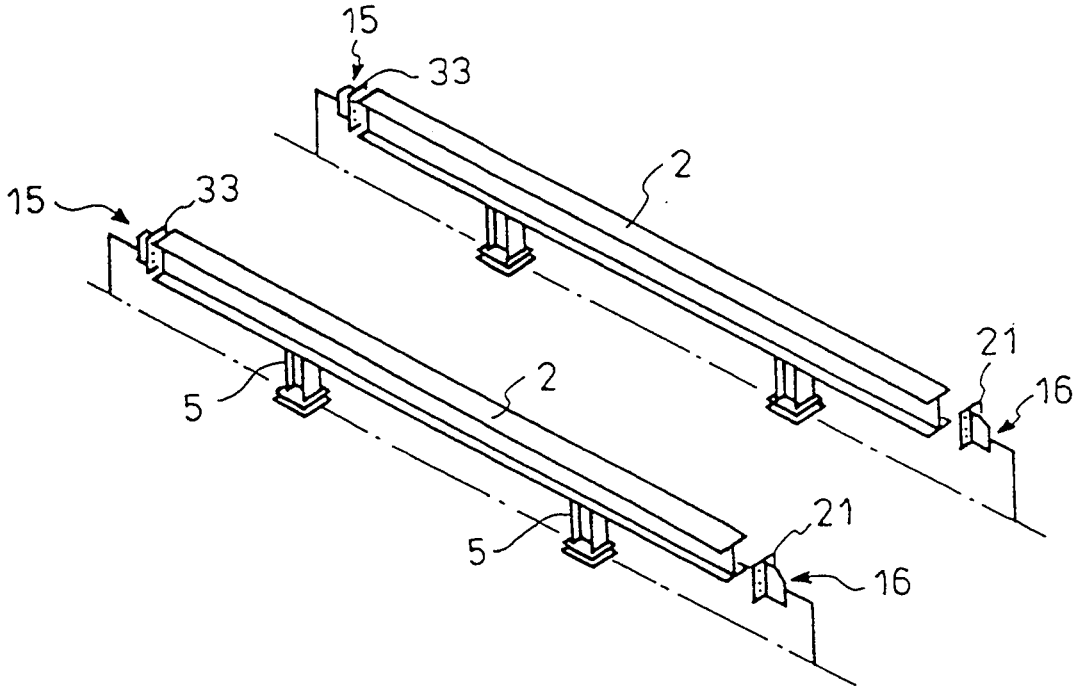
FIG. 11 is a view showing a second step of assembling a module frame work by use of the assembling device of FIG. 3.

As shown in FIG. 11, the connectors 7 are respectively positioned and mounted on the support brackets 21 and 33 of the fixed- and moving side positioning means 15 and 16 by means of the reamer pins 26 (FIG. 7). Then, each of the main beams 2 is suspended and positioned on the main-beam positioning bases 32 and 34. The movable base 22 is moved forward to abut on the positioning stop 35, so that the connector 7 is positioned along the length of the module frame work 1. The positioning in the longitudinal and lateral directions is performed by the guide member 30 and the pushing cylinder 29 of the main-beam positioning bases 32 and 34 and the height positioning is effected by the height positioning plate 31.

Figure 12:
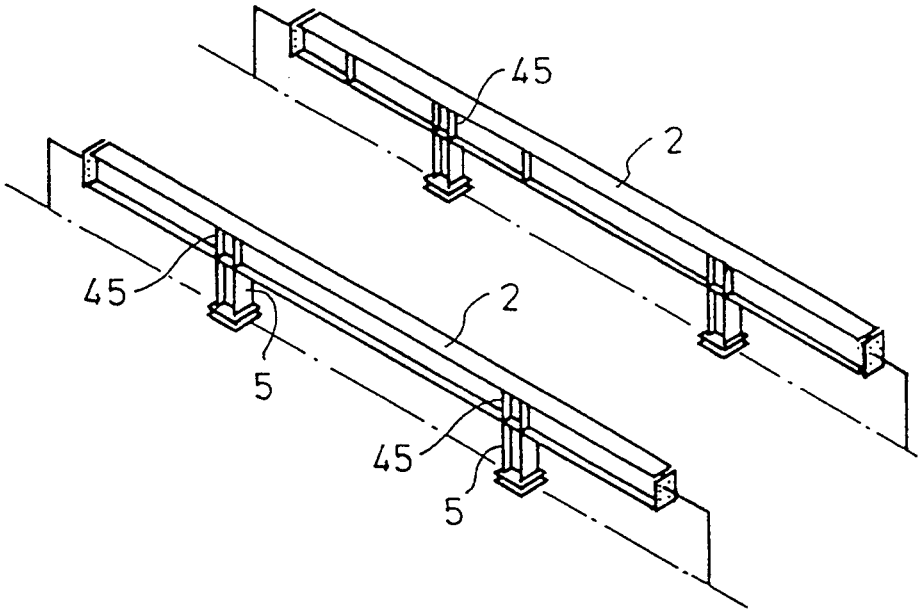
FIG. 12 is a view showing a third step of assembling a module frame work by use of the assembling device of FIG. 3.

Next, as shown in FIG. 12, the reinforcement ribs 45 are attached by welding on required points on the main beam 2.

Figure 13:
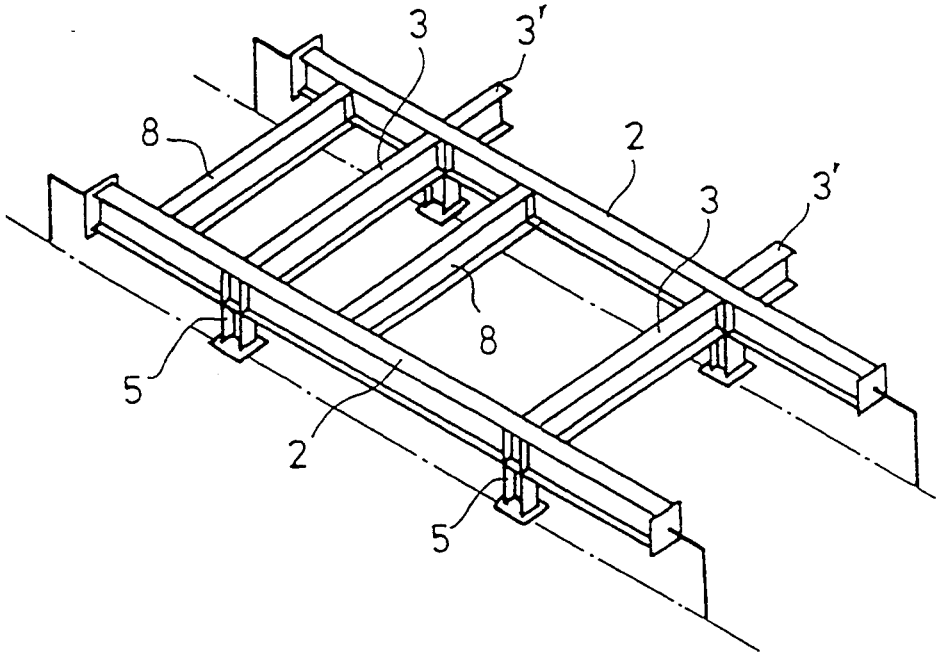
FIG. 13 is a view showing a fourth step of assembling a module frame work by use of the assembling device of FIG. 3.
Figure 14:
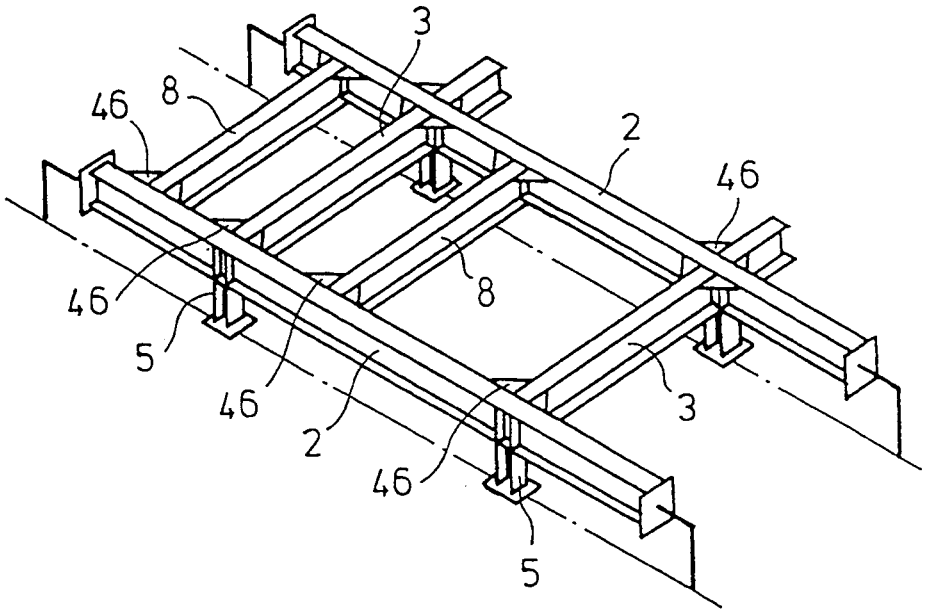
FIG. 14 is a view showing a fifth step of assembling a module frame work by use of the assembling device of FIG. 3.

Then, as shown in FIG. 13, the beam members 3 and the auxiliary beams 8 are mounted between thee main beams 2 and the extensions 3" are mounted on the outer side by welding. As shown in FIG. 14, the brackets 46 are welded for reinforcement.

Figure 8:
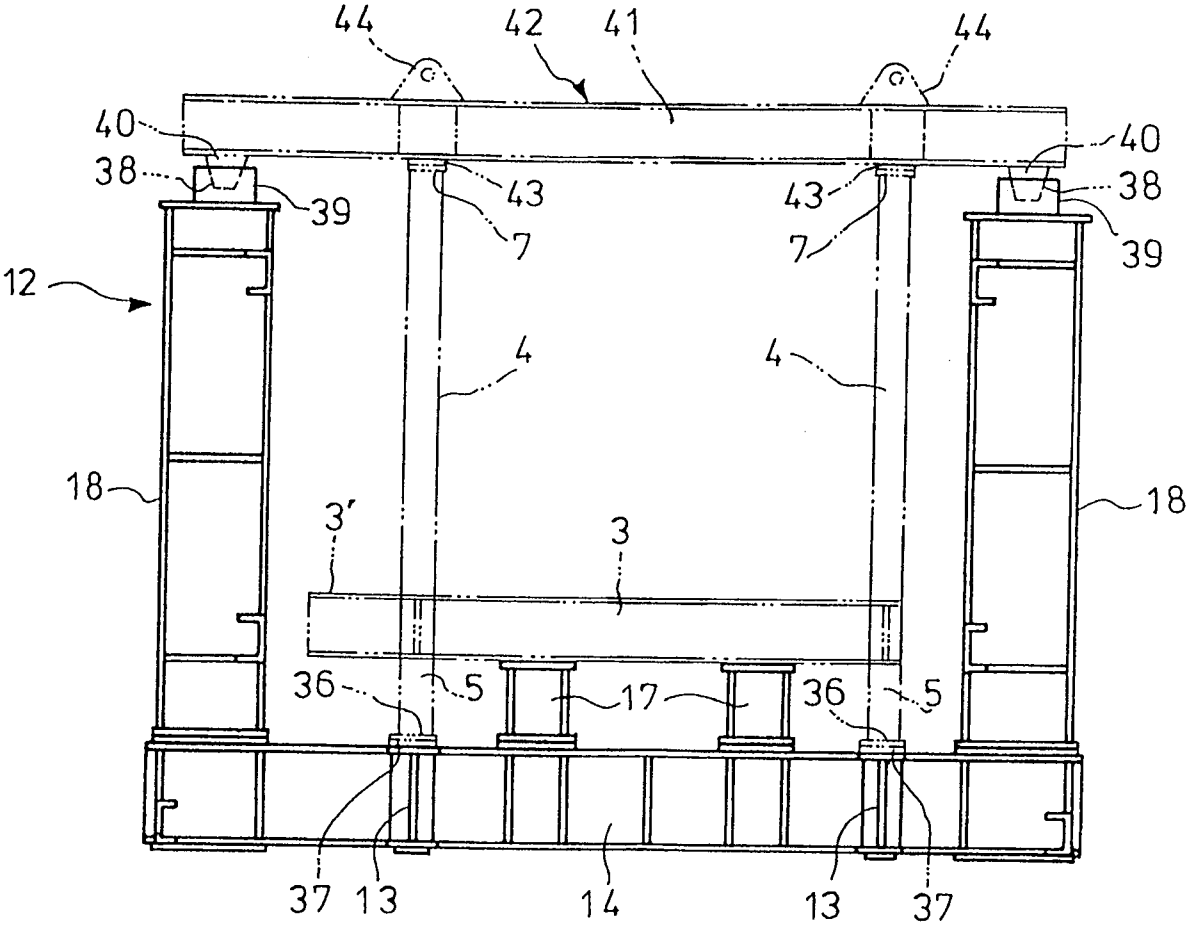
FIG. 8 is a view looking in the direction of arrows VIII—VIII in FIG. 3.
Figure 9:
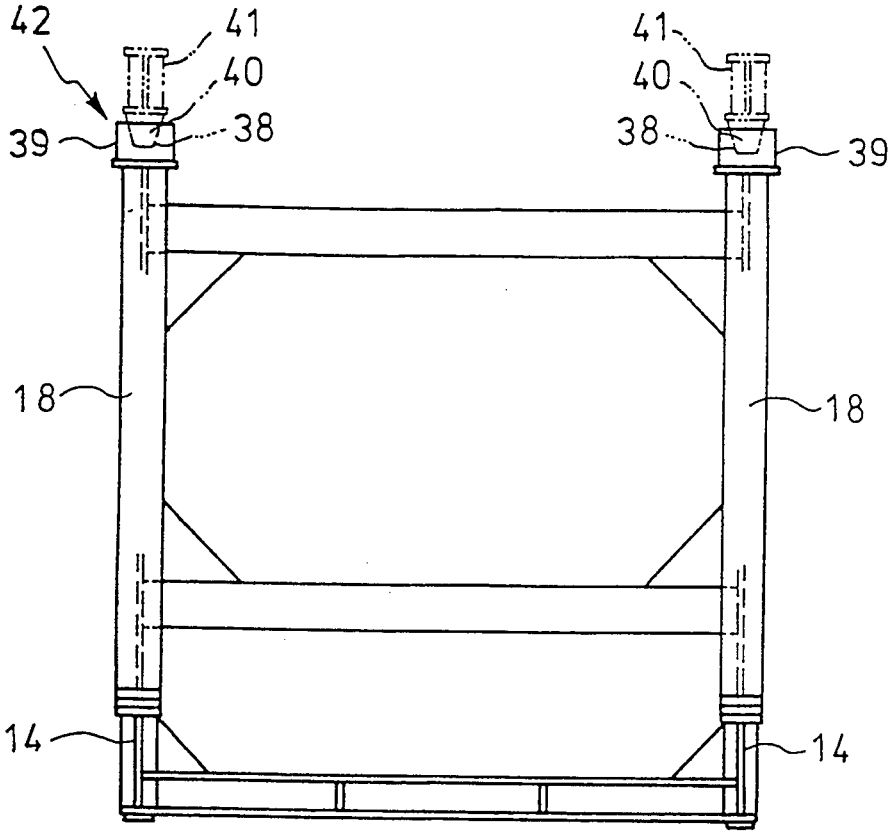
FIG. 9 is a view looking in the direction of arrows IX—IX in FIG. 3.
Figure 15:
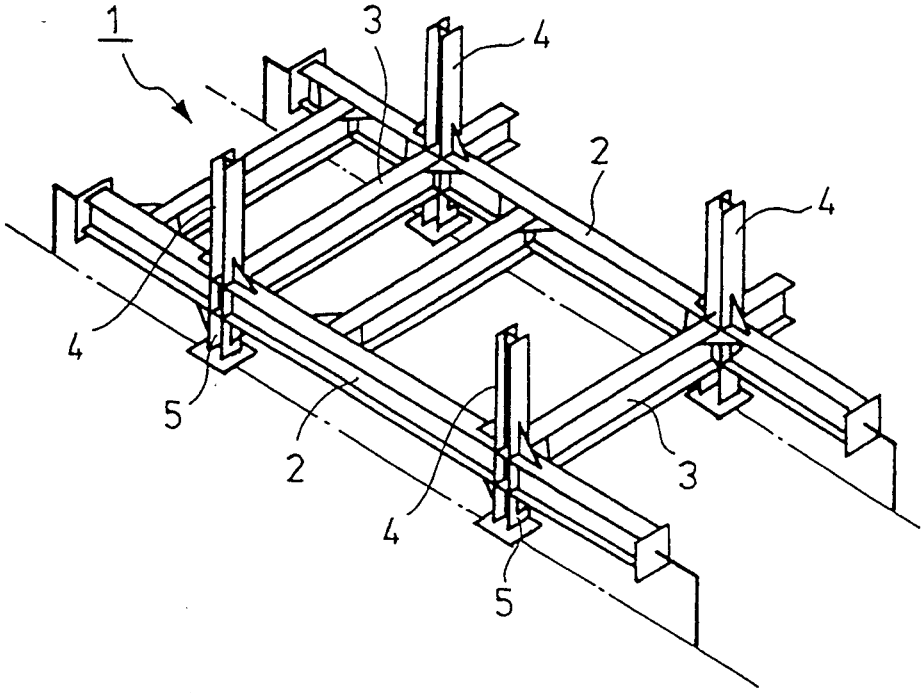
FIG. 15 is a view showing a sixth step of assembling a module frame work by use of the assembling device of FIG. 3.

As shown in FIGS. 8 and 9, the upper guide bars 41 with the support brackets 43 mounted at predetermined position thereon are placed on the upper positioning bases 18 such that the guide projections 40 of the former are engaged with the guide holes 38 of the latter. The upper column portion 4 is erected on each of the junctions of the main beams 2 and beam member 3 as shown in FIG. 15, is position-adjusted such that the upper end of the portion 4 is aligned with the corresponding support bracket 43 and then is rigidly welded at its lower end to the corresponding junction.

After the welding, welding distortion is eliminated by maintaining each portion in the restrained state until the welded portions are allowed to cool down.

Figure 16:
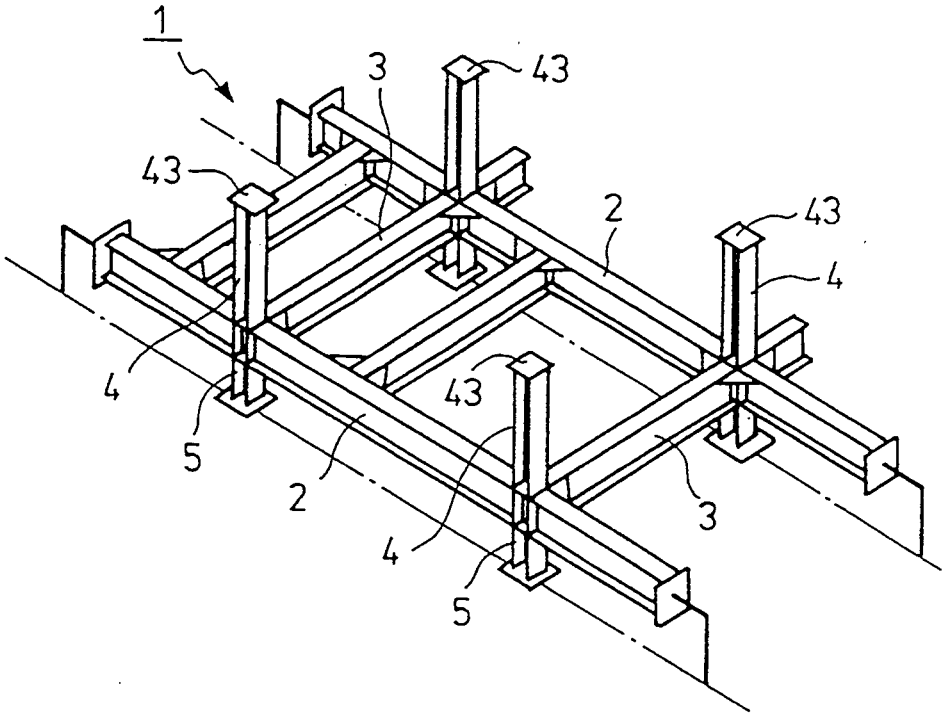
FIG. 16 is a view showing a seventh step of assembling a module frame work by use of the assembling device of FIG. 3.

Next, as shown in FIG. 16, the upper ends of the lower column portions 5 positioned are connected to the main beams 2. Each end of main beams 2, the upper ends of the upper column portions 4 are welded with and connected to the connectors 7 positioned and maintained and welding distortion is eliminated by the same procedure as described above. In this case, the lower column portions 5 may be regarded integral with the connectors 7 since they are short in length and may have less welding distortion occurring.

By the above procedure, the module frame work 1 with high accuracy can be formed.

It is advisable that components such as the main beams 2, beam members 3 and upper and lower column portions 4 and 5 for forming the module frame work 1 are accurately prepared in advance by cutting and the like to have minus size such as 0 to −2 mm relative to specified size.

It is also advisable to weld the main beams 2, beam members 3 and upper column portions 4 at other place and to use the assembling device 12 of the present invention only for welding them with connectors 7. The main beams 2, beam members 3 and support columns 6 are to have rigidity enough to support the weight of machinery to be installed and also for anti-vibration purpose. Though I-shaped steel is used in the above embodiment, H-shaped, grooved, rectangular or round shape steel or built-up material may be used instead.

Figure 17:
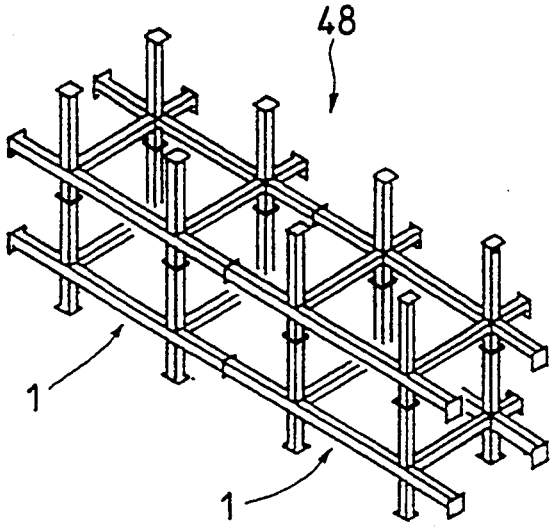
FIG. 17 is a perspective view of a module assembly which are a combination of two or more module frame works of FIG. 1.

When the module frame work 1 thus formed is used for outfitting in a large structure such as engine room of a large ship, several module frame works installed with machinery 9, piping 10, wiring 11, etc. as shown in FIG. 1 are assembled together on a ground by bolt-connecting the connectors 7 and by connecting pipings 10 and wirings so as to form a module frame work assembly 48 in which all or part of outfittings functionally related to each other are furnished and which has a size installable in the hull (see FIG. 17.)

Figure 18:
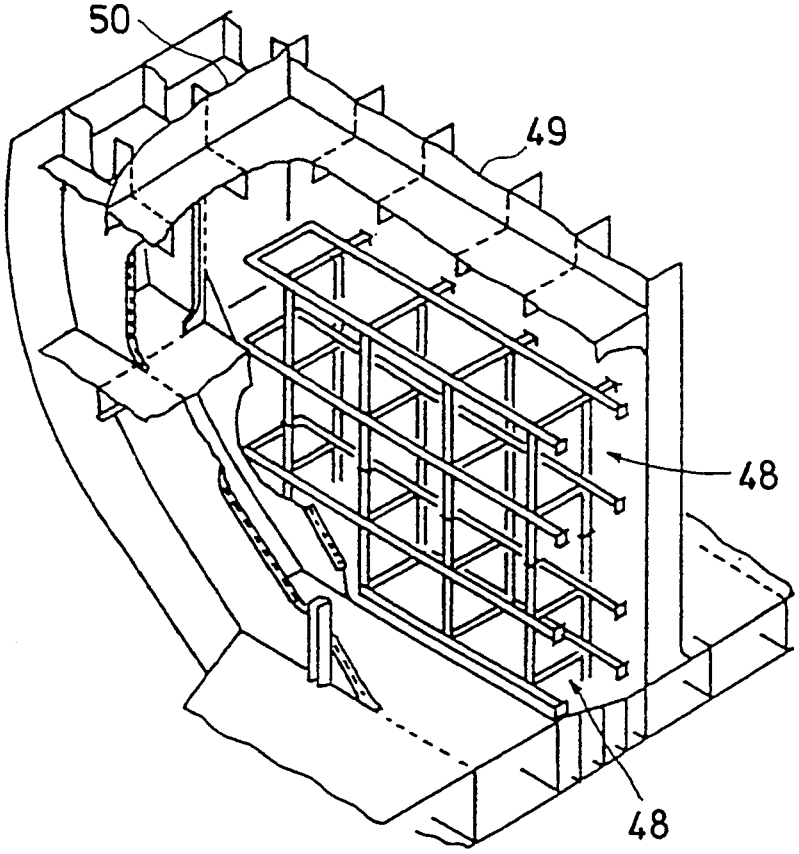
FIG. 18 is a perspective view showing the module assembly of FIG. 17 installed in a larger structure.

Such module flame work assembly 48 is prepared for each function, and each of these assemblies 48 is installed and arranged three-dimensionally at a predetermined position in the engine room. As shown in FIG. 18, connection is made between the engine room floor and the assemblies 48, between each of these assemblies 48 as well as between the assemblies 48 and a transverse bulkhead 49 or a longitudinal bulkhead 50 of the engine room.

Figure 19:
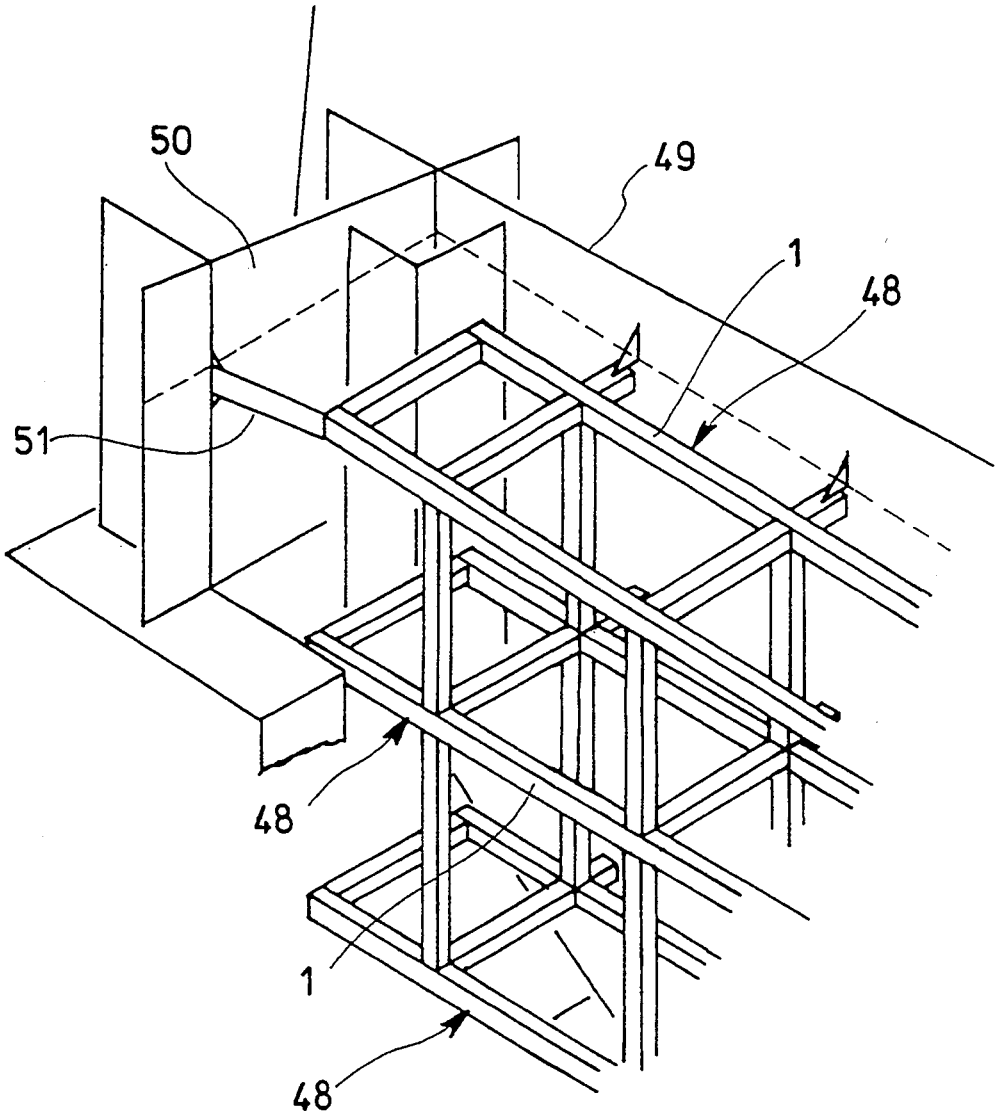
FIG. 19 is a partial enlarged view of FIG. 18.
Figure 20:
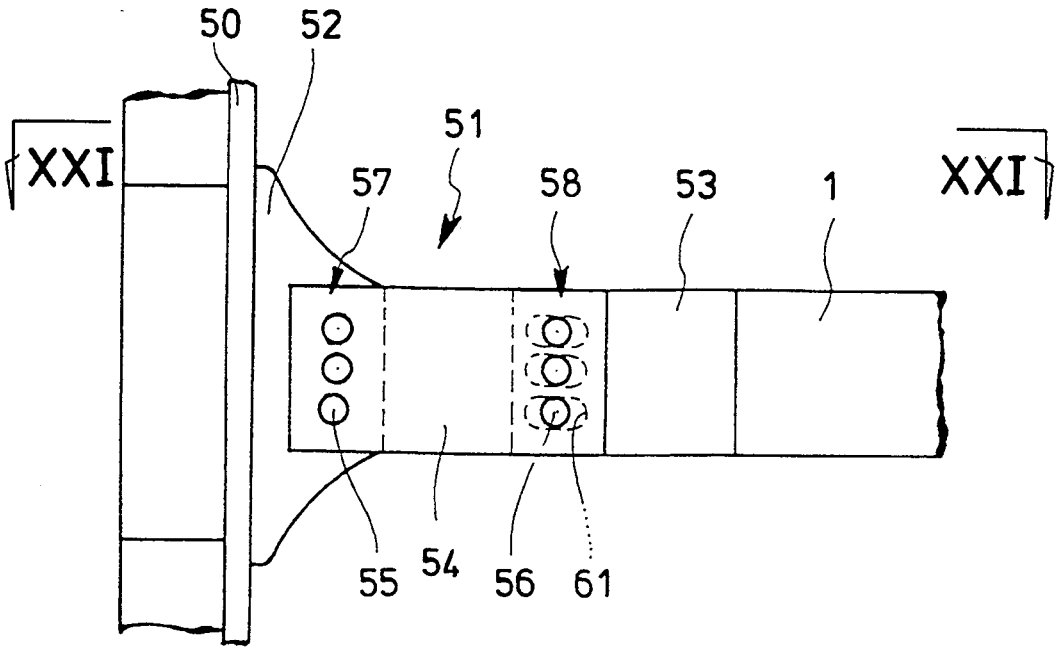
FIG. 20 is an enlarged side view of a coupler of FIG. 19.
Figure 21:
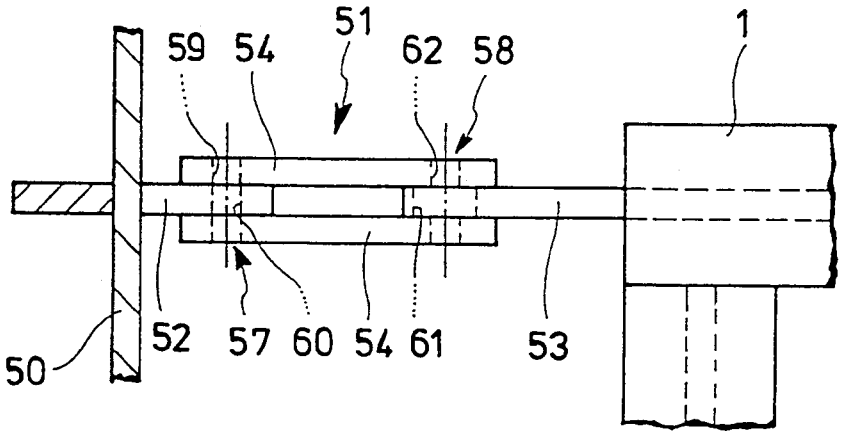
FIG. 21 is a sectional view taken along the line XXI—XXI of FIG. 20.

As shown in FIGS. 19 to 21, a coupler 51 for coupling the module frame work 1 to the longitudinal bulkhead 50 comprises doubling plates 54 to squeeze elbow plates 52 and 53 fixed respectively on the bulkhead 50 and on the module frame work 1 from opposite sides and tighten them by bolts 55 and 56. Some of bolt holes 59, 60, 61 and 62 for bolt-tightened portions 57 and 58 are in the form of slot (in the drawing, the holes 61 are slots as shown in dotted lines).

In the above, the module frame work 1 is designed in container size (size for containerization) and is easy to transport. Accordingly, the work to install or mount various types of machinery 9 can be carried out at a place with better working environment. Since division of outfittings for modularizaiton and module manufacture can be performed according to the module frame work 1 manufactured with high accuracy, it is possible to improve the accuracy in installing or mounting outfittings on the module frame work 1 and to standardize the module frame work assembly 48. Further, it is possible to have efficient three-dimensional arrangement effectively utilizing a space since the module frame work 1 is designed in three-dimensional structure of the form of "#". Moreover, the module frame works 1 with "#" form can be easily connected with each other while maintaining high accuracy since they have fewer points to be connected as compared with connection of box type structures.

Connection of the module frame work 1 with the longitudinal bulkhead 50 through the coupling 51 of the above arrangement is advantageous in that, when high oscillation or vibration occurs on a ship and an excessive load is applied to the bolt-tightened portions 57 and 58, application of excessive force to the module frame work 1 is prevented by relative sliding motion between the plates 53 and 54 or the plates 53 and 52 owing to the above-mentioned slot holes on the bolt-tightened portion 57 or 58. That is, no excessive force is applied to the module frame work 1 and no high external force is applied to outfittings installed on the module frame work 1, which contributes to safety for the assembly 48.

Slots may be provided for any of the bolts 59 to 62.

Figure 22:
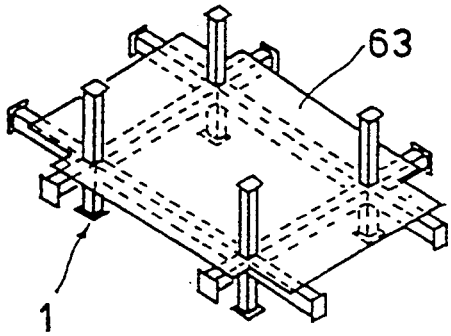
FIG. 22 is a perspective view showing a second embodiment of a module frame work according to the present invention.

FIG. 22 shows a second embodiment of the module frame work according to the present invention which is substantially the same in construction as the above-mentioned first embodiment except for a floor 63 furnished on the module frame work 1 and therefore accomplishes the same effects and advantages as those of the first embodiment.

Figure 23:
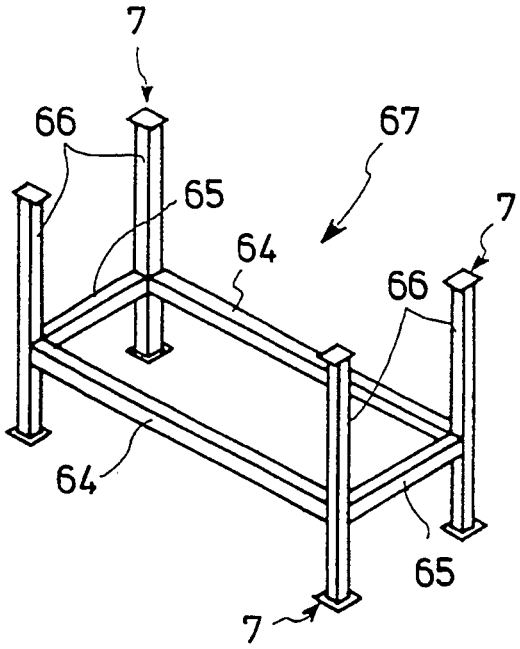
FIG. 23 is a perspective view showing a third embodiment of a module frame work according to the present invention.

FIG. 23 represents a third embodiment of the module frame work according to the present invention in which a module frame work 67 is formed by assembling main beams 64 and beam members 65 in rectangular form. Support columns 66 are connected to four apexes of the rectangle. The third embodiment accomplishes substantially the same effects and advantages as those of the first or second embodiment.

Figure 24:
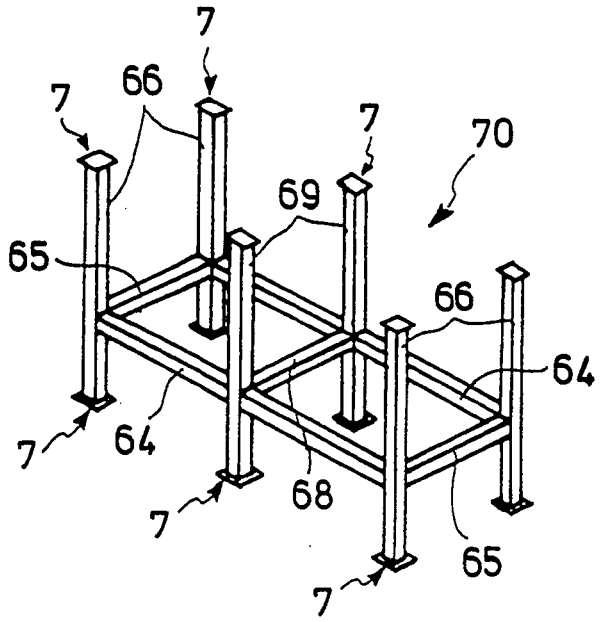
FIG. 24 is a perspective view showing a fourth embodiment of a module frame work according to the present invention.

FIG. 24 represents a fourth embodiment of the module frame work according to the present invention which is substantially the same in construction as the third embodiment except that a module frame work 70 has an intermediate beam member 68 and intermediate support columns 69 at the central portion of the main beam 64. The fourth embodiment accomplishes substantially the same effects and advantages as those of any of the above-mentioned embodiments.

Figure 25:
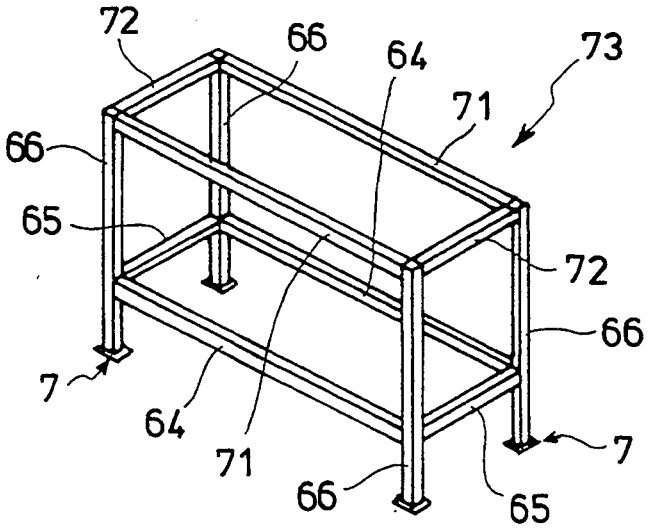
FIG. 25 is a perspective view showing a fifth embodiment of a module frame work according to the present invention.

FIG. 25 represents a fifth embodiment of the module frame work according to the present invention which is substantially the same in construction as the second embodiment except that a module frame work 73 has upper main beams 71 and upper beam members 72. The fifth embodiment accomplishes substantially the same effects and advantages as those of any of the above-mentioned embodiments.

Figure 26:
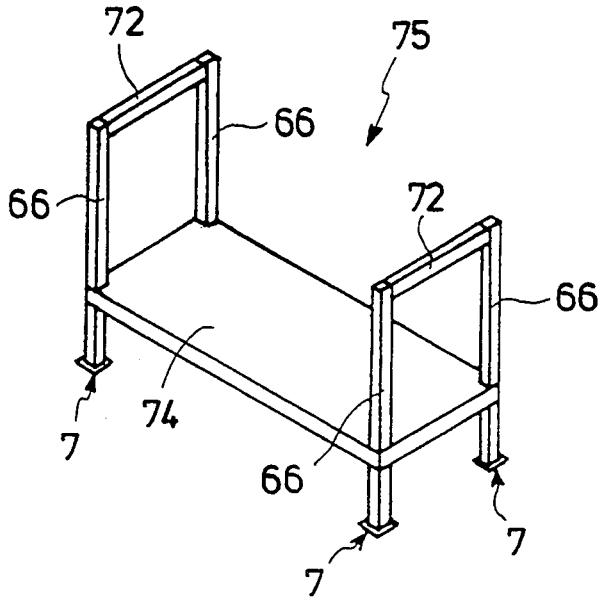
FIG. 26 is a perspective view showing a sixth embodiment of a module frame work according to the present invention.

FIG. 26 shows a sixth embodiment of the module frame work of the present invention. A module frame work 75 comprises a rectangular floor member 74, support columns 66 connected at their midways to the respective apexes of the floor member 74 and upper beam members 72 connecting the upper ends of the support column 66. The sixth embodiment accomplishes substantially the same effects and advantages as those of any of the above-mentioned embodiments.

Figure 27:
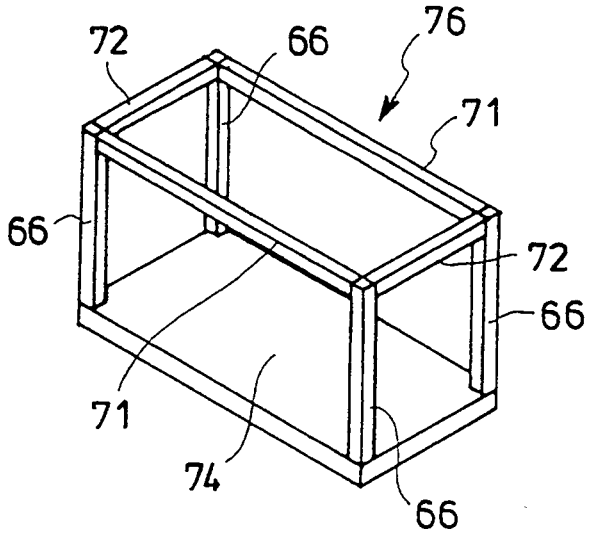
FIG. 27 is a perspective view showing a seventh embodiment of a module frame work according to the present invention.

FIG. 27 is a seventh embodiment of the module frame work of the present invention. A module frame work 76 comprises a rectangular floor member 74, supports columns 66 connected at their lower ends to the apexes of the floor member 74, and upper main beams 71 and upper beam members 72 connected between upper ends of the support columns 66. The seventh embodiment accomplishes substantially the same effects and advantages as those of any of the above-mentioned embodiments.

Figure 28:
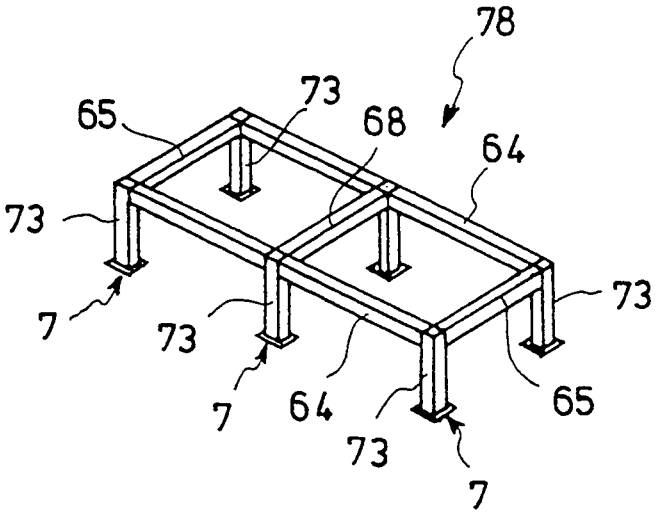
FIG. 28 is a perspective view showing an eighth embodiment of a module frame work according to the present invention.

FIG. 28 is an eighth embodiment of the module frame work of the present invention which is substantially the same in construction as the fourth embodiment except that a module frame work 78 includes lower support columns 73 in place of the columns 66 and 69. The eighth embodiment accomplish substantially the same effects and advantages as those of any of the above-mentioned embodiments and is especially suitable for arrangement at uppermost or lowermost position.

Figure 29:
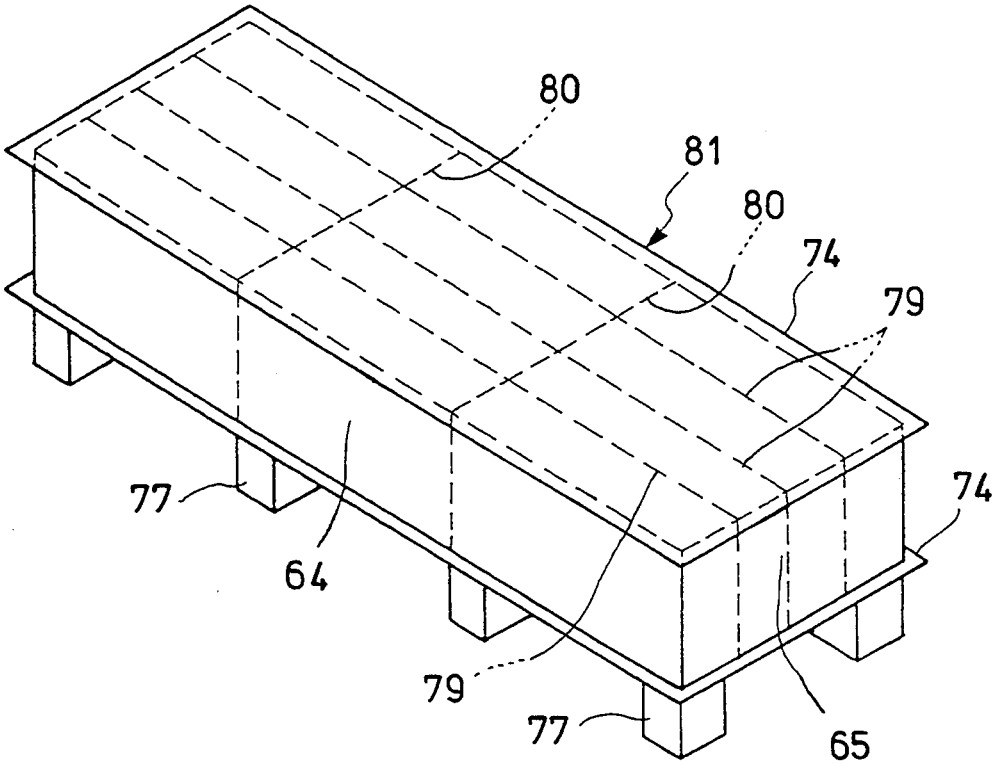
FIG. 29 is a perspective view showing a ninth embodiment of a module frame work according to the present invention.

FIG. 29 shows a ninth embodiment of the module frame work of the present invention in which a module frame work 81 comprises main beams 64, beam members 65, auxiliary crossbeams 79 and beams 80 inside the parts 64 and 65, upper and lower floor members 74 and lower support columns 77 on the lower floor member 74. The ninth embodiment accomplishes substantially the same effects and advantages as those of the above-mentioned embodiments.

Figure 30:
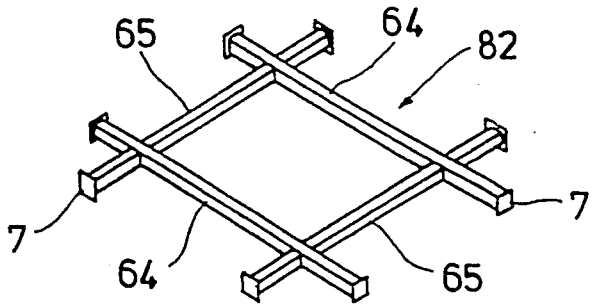
FIG. 30 is a perspective view showing a tenth embodiment of a module frame work according to the present invention.

FIG. 30 is a tenth embodiment of the module frame work of the present invention. A two-dimensional module frame work 82 is composed only by main beams 64 and beam members 65. The tenth embodiment accomplishes substantially the same effects and advantages as those of the above-mentioned embodiments.

Figure 31:
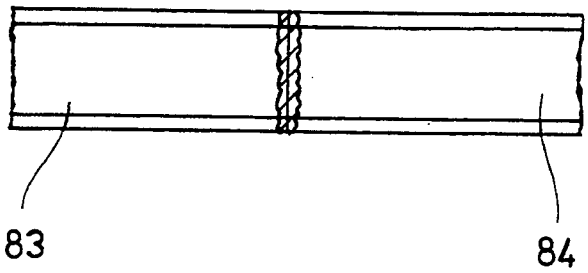
FIG. 31 is a side view showing a second embodiment of a connector for a module frame work.
Figure 32:
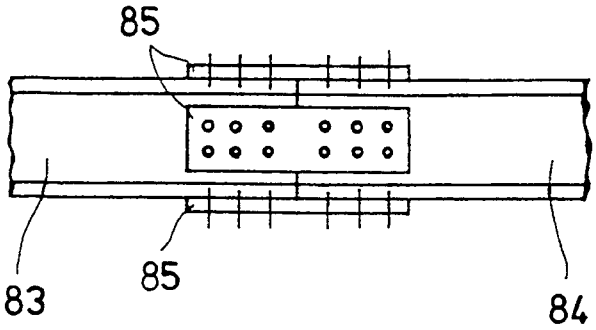
FIG. 32 is a side view showing a third embodiment of a connector for a module frame work.
Figure 33:
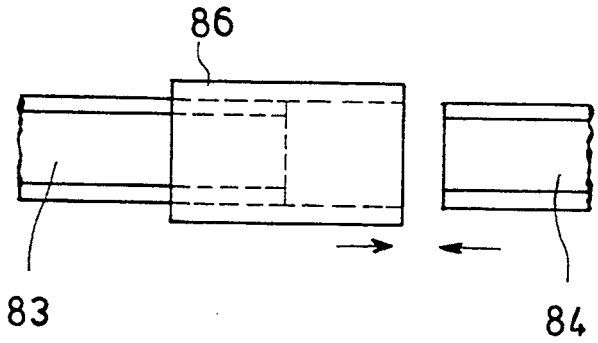
FIG. 33 is a side view showing a fourth embodiment of a connector for a module frame work.
Figure 34:
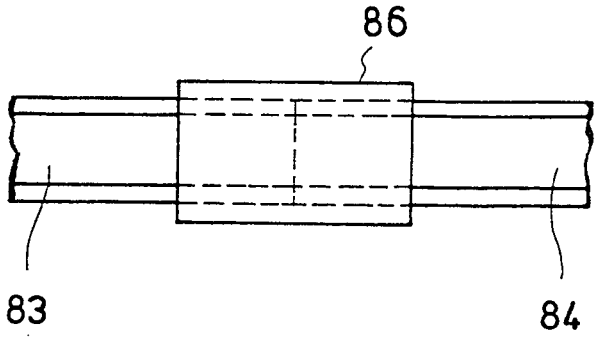
FIG. 34 is a view showing a state of being connected by the connector of FIG. 33.
Figure 35:
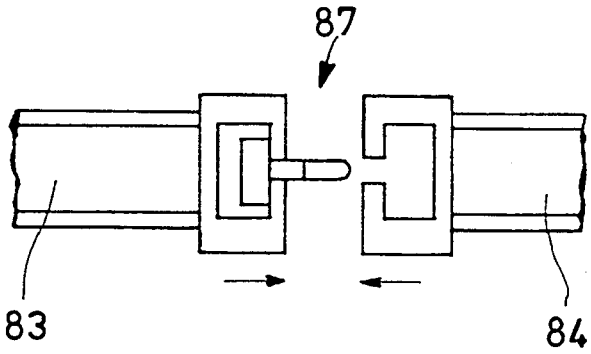
FIG. 35 is a side view showing a fifth embodiment of a connector for a module frame work.
Figure 36:
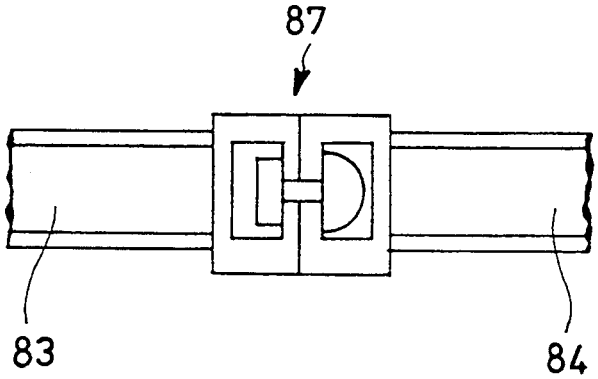
FIG. 36 is a view showing a state of being connected by the connector of FIG. 35.

In the embodiments described above, the module frame works 1, 67, 70, 73, 75, 78, 81 and 82 are interconnected by bolt-connecting the mutually abutting connectors 7. Alternatively, as shown in FIG. 31, the module frame works may be interconnected by butt welding connecting ends 83 and 84 of the module frame works, bolt-connecting them using batten plates 85 as shown in FIG. 32, sleeve-connecting them using a sleeve 86 as shown in FIGS. 33 and 34 or the lock-connecting them using a twist lock key 87 as shown in FIGS. 35 and 36. These connecting methods may be used in combination.

Figure 37:
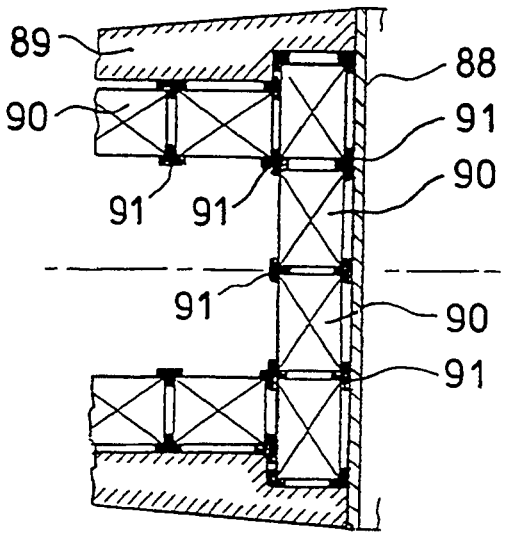
FIG. 37 is a view showing a second embodiment of a coupler of a module frame work.
Figure 38:
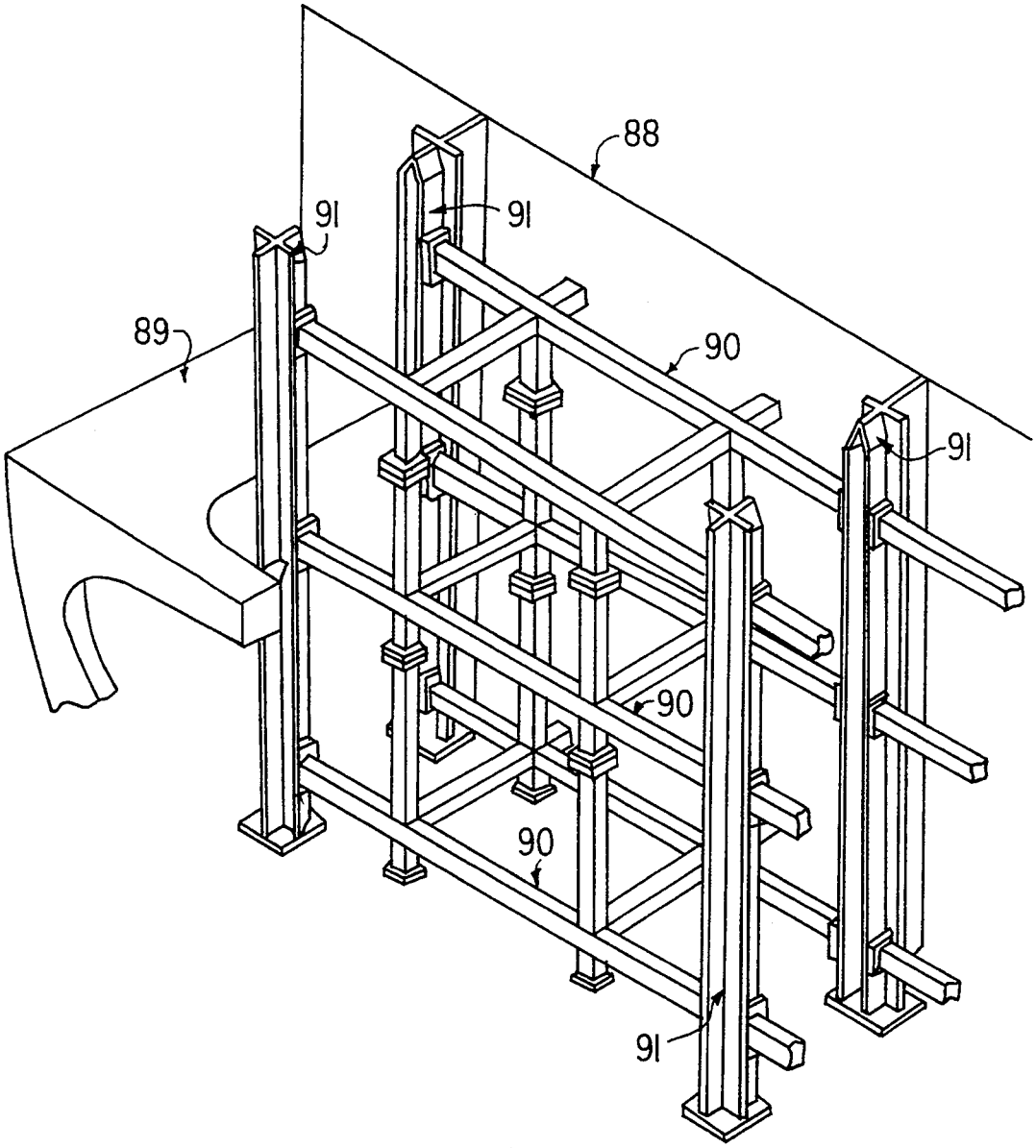
FIG. 38 is a perspective view of the coupler of FIG. 37.

FIGS. 37 and 38 show a second embodiment of a coupling for the module frame work according to the present invention in which guide rails 91 extend on a front wall 88 and deck 89 of the engine room in the vertical direction and with mutual spacings corresponding to the size of each of the module frame works 90. The module frame works 90 are mounted and installed using the guide rails 91.

Since the guide rails 91 are installed at the predetermined spacings along which the module frame works 90 are mounted and installed, there is no need of interconnecting the module frame works 90 and the installation accuracy is improved. Therefore, a working period of mounting and installation can be extensively shortened since the mounting and installing operations are much facilitated. Since the module frame works 90 are mechanically protected after installation by the guide rails 91, there is no need of increasing the strength of the frame work itself for protection against ship vibration and therefore minimal strength will suffice. Moreover, even if the module frame work 90 with reduced mechanical strength causes deformation of the same during lifting operation for installation, such deformation is compensated only by placing the module frame work 90 within the guide rails 91. Even when the hull structure lacks accuracy, such inaccuracy is absorbed by the guide rails 91 and does not exert influence on the module frame works 90. Moreover, the guide rails 91 which also serve as part of reinforcement means of the hull structure will enable structural members of an engine room to be designed with less strength.

In the above invention, description has been given on the case where the module frame work is designed in container size. However, the claimed module frame work is not limited to this size and may be designed in any size required. Also, the embodiments have been described for applications to the ships; however, it is needless to say that the present invention may be applied for manufacture of module for all types of mechanical plants including the other marine structures or land structures. Thus, various modifications and changes may be made within the true spirit of the present invention.

What is claimed is:

1. A method of coupling a unitary module frame carrying parts of a complete outfitting to an inside portion of a ship structure, said frame having side portions, comprising locating said frame with its side portions spaced apart from said inside portion, fixing one each of a pair of elbow plates respectively to said inside portion of said ship structure and to said side portions of said frame, said elbow plates being spaced apart and substantially aligned with each other in a common plane and each having bolt holes therein, and bolting one each of a pair of doubling plates to opposed sides of said elbow plates through bolt holes in said doubling plates which said bolts holes align with each other in the respective doubling plates and with said bolt holes in said elbow plates to connect said ship structure with said frame, whereby the bolt holes in at least one of said elbow plates and the pair of doubling plates being defined by horizontally extending slots, and adjusting movement of said frame relative to said ship structure.

* * * * *